US005913433A

United States Patent [19]

Belokin et al.

[11] Patent Number: 5,913,433

[45] Date of Patent: Jun. 22, 1999

[54] DISPLAY SHELF FOR ELONGATED PRODUCTS

[76] Inventors: Paul Belokin; Martin P. Belokin, both of 7801 I-35 North, Denton, Tex. 76202; Norman P. Belokin, 1606 Oak Ridge Dr., Corinth, Tex. 76205

[21] Appl. No.: 08/998,193

[22] Filed: Dec. 24, 1997

[51] Int. Cl.[6] ..... A47F 5/00

[52] U.S. Cl. ..... 211/90.01; 211/88.01; 211/75; 211/85.18; 248/206.4

[58] Field of Search ..... 211/75, 88.01, 211/90.01, 72, 73, 85.18, 85.23, 88.03; 248/205.5, 206.3, 206.4

[56] References Cited

U.S. PATENT DOCUMENTS

| | | | |
|---|---|---|---|
| 1,840,763 | 1/1932 | Benchley . | |
| 2,593,697 | 4/1952 | Reilly . | |
| 4,508,303 | 4/1985 | Beckerer | 211/75 X |
| 4,984,693 | 1/1991 | Belokin et al. | 211/88.01 |
| 5,096,272 | 3/1992 | Belokin et al. | 211/90.01 X |
| 5,351,841 | 10/1994 | Belokin et al. | 211/88.01 |
| 5,486,044 | 1/1996 | Bennett | 211/88.01 X |

*Primary Examiner*—Robert W. Gibson, Jr.
*Attorney, Agent, or Firm*—Jack A. Kanz

[57] ABSTRACT

A display shelf which employs a mounting or support panel for attachment to one face of a transparent wall is provided with a floor which projects from the top edge of the support panel and a containment wall which projects upwardly from the floor. The support panel does not extend above the floor in the area which supports displayed product so that the product is visible through the transparent wall. Advertising material may be displayed on the support panel below the floor and the containment wall and/or floor may be appropriately shaped to provide individual compartments for each unit of product displayed.

28 Claims, 5 Drawing Sheets

DISPLAY SHELF FOR ELONGATED PRODUCTS

This invention relates to display of elongated products and product containers such as candy bars, bottles, cans and the like. More particularly, it relates to display shelves adapted for mounting on one face of a substantially transparent wall to support the products on the wall and display the product through the transparent wall.

Retail businesses commonly display chilled products for sale in refrigerated vaults or the like which have a transparent door or wall panel. Because a passing customer is more likely to select and purchase products displayed where they can be readily seen and recognized, the retailer desires to maximize visibility of products on display and also to maximize utilization of space within the refrigerated area.

Many products are elongated or packaged in elongated containers such as bottles, cans and the like. In order to advantageously display such products, they must be arranged vertically or horizontally. In order to maximize use of visible space on a transparent panel, the display shelf must permit unobstructed view of the displayed product, selectively position the product units adjacent the transparent panel, and also display advertising or the like related to the displayed products.

In accordance with the present invention, display shelves are provided which are adapted to be mounted on the face of a substantially transparent panel such as a glass window or door. The display shelves may be adapted to uniformly support elongated products horizontally or vertically and find particular utility when mounted in a refrigerated vault or the like to display products through a transparent wall or door of the vault. However, the display shelves of the invention may be used in conjunction with any transparent wall, window, door or the like.

The display shelf of the invention comprises a mounting or support panel which has a vertically arranged front face and mounting slots, holes or the like for mounting the front face of the support panel adjacent the surface of a substantially transparent wall, window, door or the like. The support panel defines a lower edge, two laterally opposed end edges and an upper edge. A floor extends horizontally (normal to the plane of the support panel) from the upper edge of the support panel. A containment wall is positioned at the edge of the floor remote from the support panel and cooperates with the transparent wall to contain elongated products or product containers on the floor (arranged vertically or horizontally) and adjacent the transparent wall on which the display shelf is mounted. The containment wall may be shaped to conform to individual product units and thereby confine them in restricted positions on the shelf. The containment wall may also be slotted and/or curved outwardly to permit easy access to and removal of products from the shelf The support panel extends downwardly from the front edge of the floor, thus providing rigid support for the floor. The upper edge of the support panel does not extend above the floor in the area of the floor which supports displayed product so that the entire vertical height of the product is visible through the transparent wall. However, since the support panel is positioned below the floor, advertising material or the like may be displayed on the face of the support panel to be visible through the transparent wall without obstructing the view of the product.

Other features and advantages of the invention will become more readily understood from the following detailed description taken in connection with the appended claims and attached drawing in which:

Figure 1:
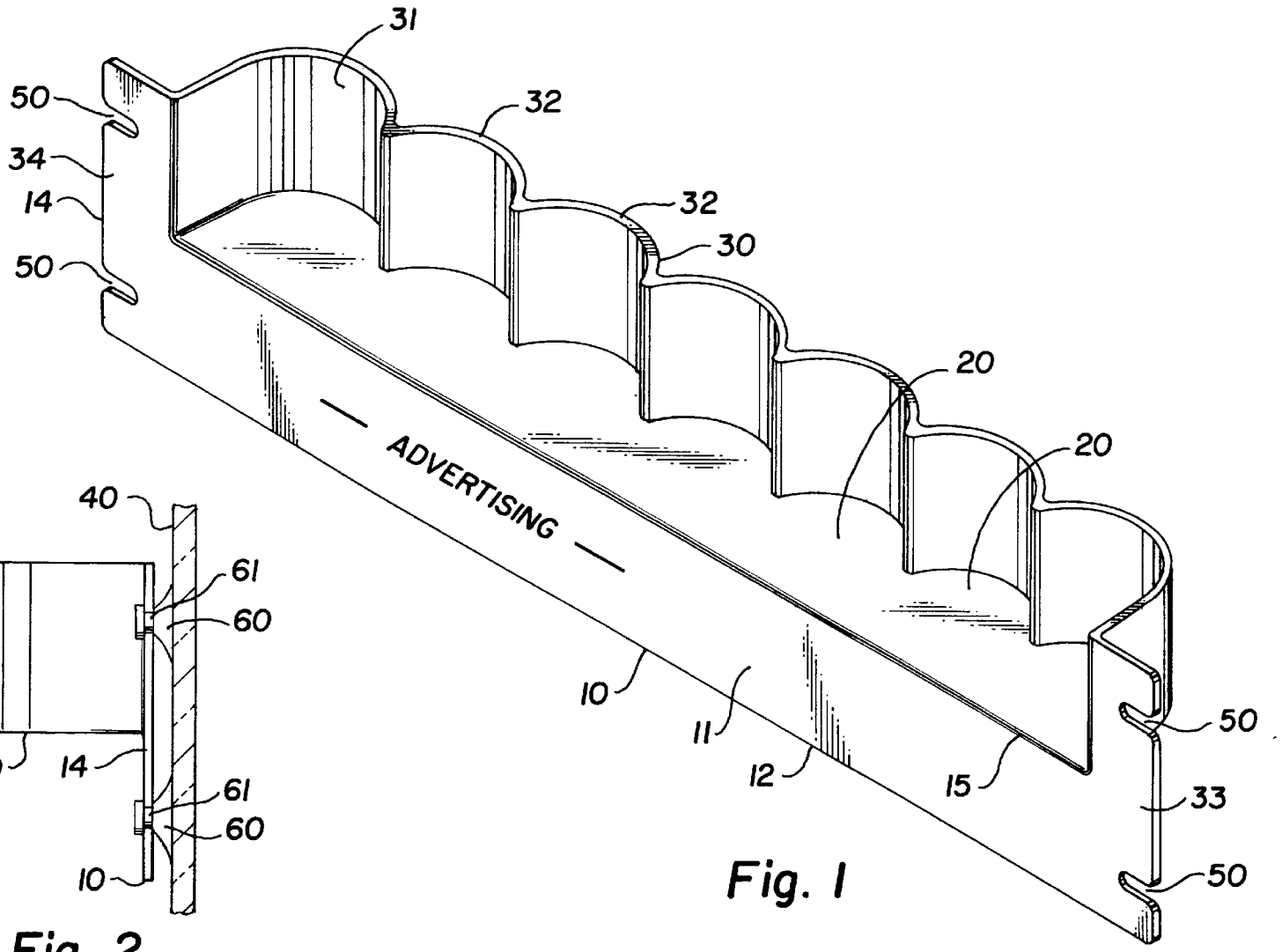
FIG. 1 is a front perspective view of a preferred embodiment of the display shelf of the invention.

The above-described drawing is incorporated into and forms part of the specification to illustrate several exemplary embodiments of the present invention. Throughout the drawing, like reference numerals designate corresponding elements. This drawing, together with the description, serves to explain the principles of the invention and is only for the purpose of illustrating preferred and alternative examples of how the invention can be made and used. The drawing is not to be construed as limiting the invention to only the illustrated and described examples.

Figure 2:
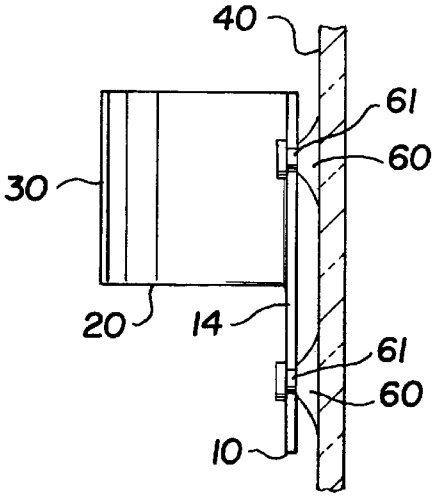
FIG. 2 is an end view of the embodiment of FIG. 1 illustrating placement and attachment of the display shelf on a transparent wall.

In the embodiment illustrated in FIGS. 1 and 2 the display shelf comprises a mounting or support panel 10 which has a first face 11 lying in a substantially vertical plane and defining lower edge 12, first and second laterally opposed end edges 13, 14 and an upper edge 15. Floor 20 is supported on the support panel and has a top face 21 which lies in a plane substantially normal to the plane of first face 11 and intersects the plane of the first face 11 above the lower edge of the support panel. The top face 21 of floor 20 thus defines the upper edge of the support panel 10 for a substantial lateral portion thereof along the distance between the laterally opposed ends 13, 14 of the support panel 10.

A containment wall 30 extends upwardly from the top face 21 of the floor 20. A major portion of wall 30 is spaced horizontally from the plane of first face 11 of the support panel 10. The ends of the containment wall join the support panel 10 to define a open-topped cavity 31 defined by floor 20, containment wall 30 and the transparent wall 40 (see FIG. 2) on which the display shelf is mounted. In the embodiment shown in FIG. 1, the ends of containment wall 30 join support panel 10 at positions interiorly spaced from first and second edges 13, 14 and the support panel 10 extends upwardly from the plane of top face 21 of the floor 20 and outwardly from the ends of the containment wall 30 to define flanges 33, 34. Flanges 33, 34 thus form coplanar extensions of support panel 10.

Figure 3:
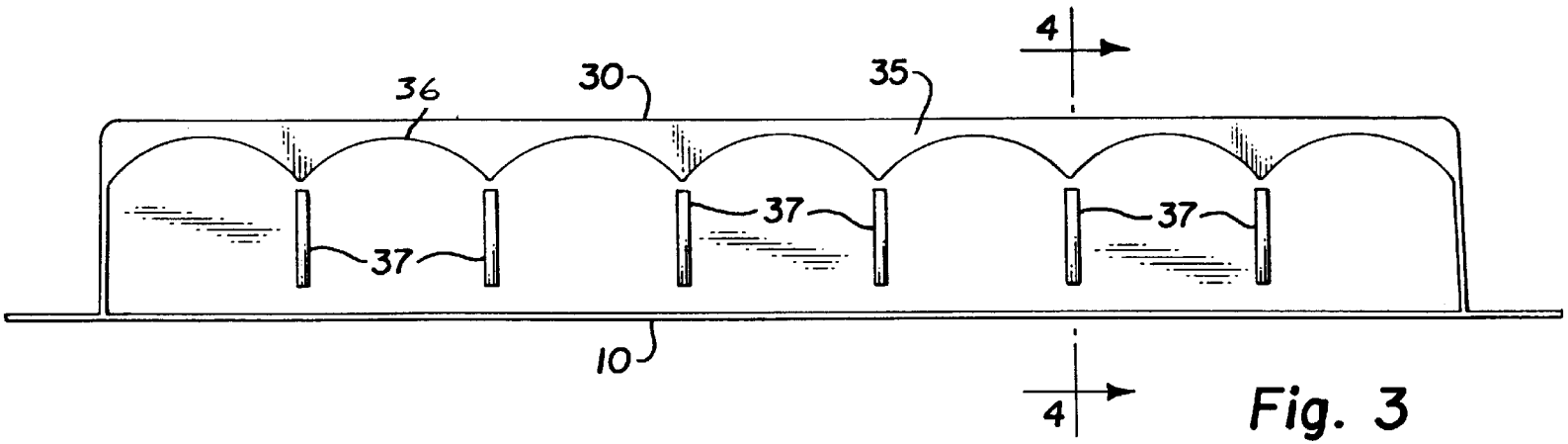
FIG. 3 is a top plan view of an alternative embodiment of the display shelf of the invention.
Figure 4:
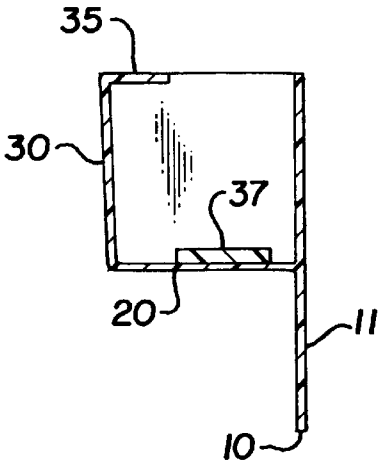
FIG. 4 is a sectional view of the embodiment of FIG. 3 taken along line 4—4.

In the embodiment illustrated in FIGS. 1 and 2 the containment wall 30 defines a plurality of joined vertically extending semi-cylindrical sections shaped to define individual containment compartments for a plurality of individual vertically arranged cylindrical or otherwise vertically extending products or packages. In the embodiment of FIG. 1 each section is a semi-cylindrical arc extending upwardly from the floor 20. In the embodiment of FIGS. 3 and 4 the vertical portion of the containment wall 30 is substantially flat in the vertical plane. However, the top edge 35 is folded inwardly (toward the support panel 10) and shaped to include a plurality of arcuate sections 36. The arcuate sections 36 shown in FIG. 3 serve the same function as the semi-cylindrical sections 32 shown in FIG. 1. Each of the arcuate sections 36 (as well as the semi-cylindrical sections 32) are shaped to define a containment compartment for cylindrical objects such as cans, bottles, etc. Obviously, shapes other than arcuate or semi-cylindrical may be employed, depending on the shape and dimensions of the product units to be displayed. Furthermore, it is to be understood that terms such as "containment wall" and "containment compartment" as used herein are meant to describe structures which restrain movement of an object placed within the boundaries thereof and are not intended to describe fully enclosed compartments. For example, the semi-cylindrical segments 32 of wall 30 do not define enclosed containment compartments but define boundaries for supporting substantially cylindrical objects vertically. Likewise, arcuate sections 36 on top edge 35 merely define restraint devices. In the embodiment shown in FIGS. 3 and 4, the top surface 21 of floor 20 is shaped to define dividers 37 which act as containment walls or the like for restraining movement of individual products positioned on the display shelf.

Figure 5:
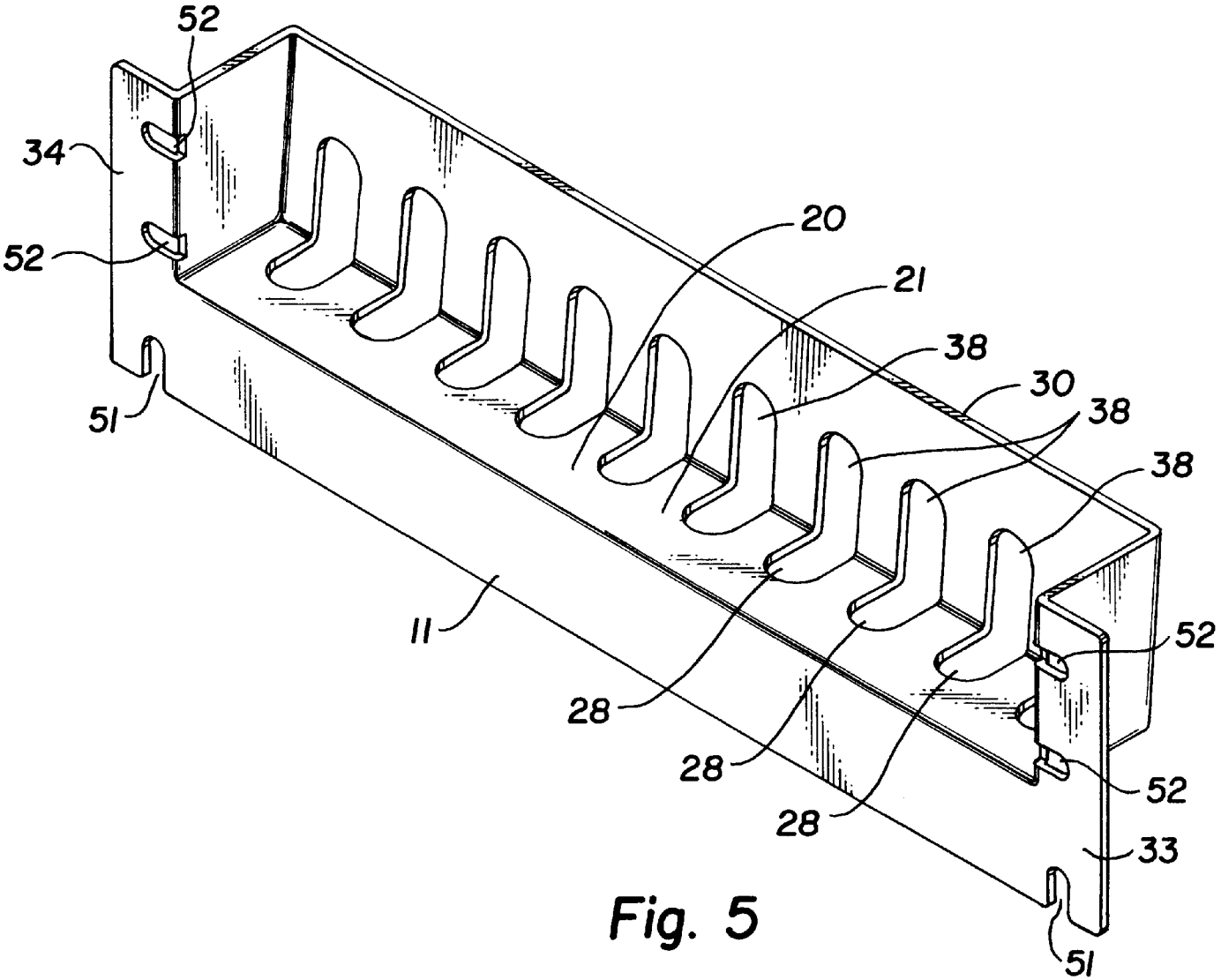
FIG. 5 is a front perspective view of another alternative embodiment of the invention.
Figure 6:
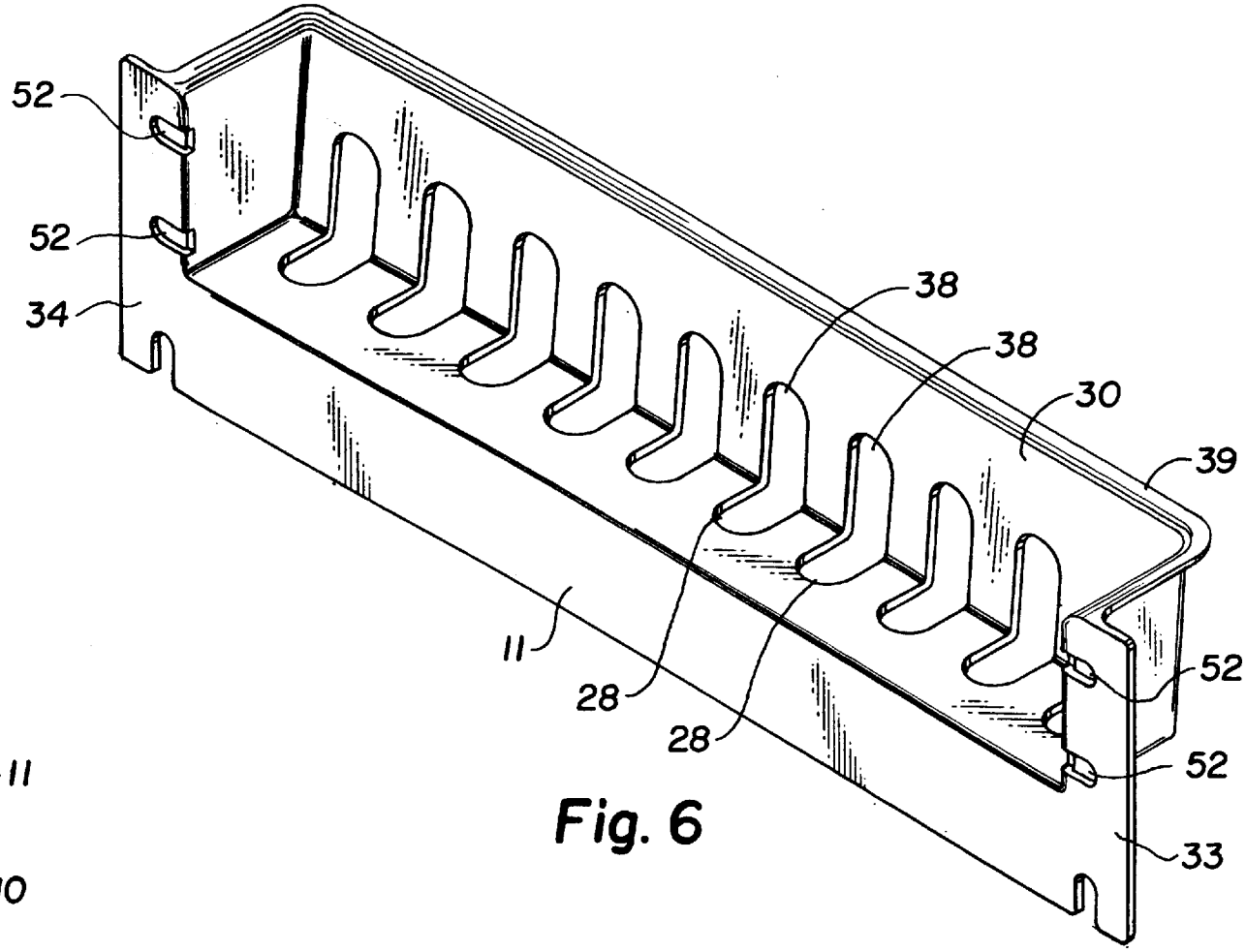
FIG. 6 is a front perspective view of yet another alternative embodiment of the invention.
Figure 7:
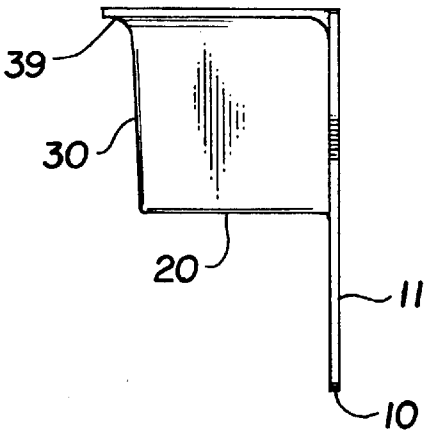
FIG. 7 is an end view of the embodiment of FIG. 6.

The embodiment of FIG. 5 is designed primarily for horizontally elongated products such as candy bars and the like. Thus the containment wall 30 defines no individual containment compartments. However, parallel slots 38 are formed in the upwardly extending back portion of containment wall 30. In the embodiment illustrated in FIG. 5 slots 28 are formed in floor 20 which join slots 38 in wall 30 to provide an opening which permits easy access to the interior of the containment wall. Accordingly, objects contained between the supporting transparent wall and containment wall 30 may be readily withdrawn from the shelf by simply inserting fingers through the slots 28, 38 and raising the object over the top of containment wall 30. In the embodiment illustrated in FIGS. 6 and 7 the top portion of containment wall 30 is curved outwardly to aid in withdrawal of objects from the cavity defined by the shelf. While only the top edge 39 of wall 30 is curved outwardly in the embodiment illustrated FIGS. 6 and 7, it will be readily appreciated that the entire containment wall 30 or any portion thereof may be slanted outwardly or otherwise curved to aid in withdrawal of objects from the cavity.

Figure 8:
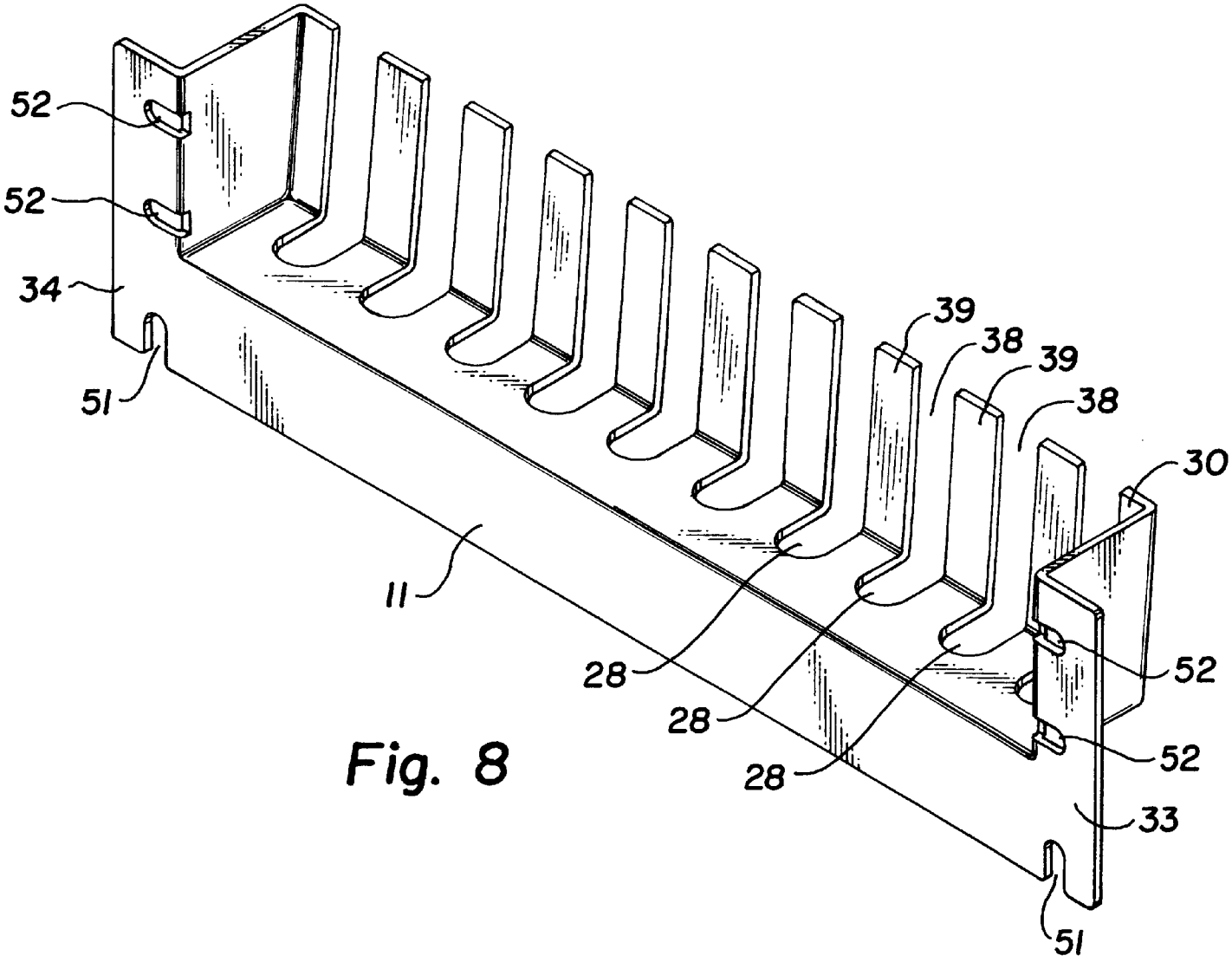
FIG. 8 is a front perspective view of yet another alternative embodiment of the invention.

In the embodiment illustrated in FIG. 8 slots 38 extend to the upper edge of wall 30 to define parallel wall fingers 39. In this arrangement, the products can be removed from the cavity of the shelf by reaching through slots 28 and withdrawing the object out the top of the cavity by moving the user's fingers through slots 38 between the wall fingers 39.

It should be recognized that the features disclosed in each of the alternative embodiments may be combined as required or desired for particular purposes. For example, slots (such as slots 28, 38) may be used in display shelves having containment compartments such as shown in FIGS. 1–4 and/or various slots, fingers, etc., may be used in connection with various other shapes of containment wall 30.

In each of the embodiments illustrated, the first face 11 of support panel 10 is positioned parallel with the surface of a transparent wall 40 on which the shelf is mounted and below the floor 20 of the shelf. Thus first face 11 may conveniently be used to support advertising or the like which is visible through the transparent wall 40 immediately below the product supported by the shelf 20. Positioning the support panel 10 to extend the full length of and past the outer edges of floor 20 provides rigid support for the floor 20 and permits display of advertising or other information associated with the displayed product on the support panel 10 without obstructing view of the displayed product.

The outer edges of support panel 10 terminate in flanges 33, 34 as described hereinabove. As illustrated in FIG. 1, the flanges 33 and 34 may include slots 50 for mounting the support panel 10 adjacent the inner surface of a transparent wall 40 as shown in FIG. 2. Various means for securing the support panel 10 to the transparent wall, such as suction cups 60 or the like, may be used. As illustrated in FIG. 2, suction cups 60 each have a shank 61 which extends through a slot 50 and thus support the first face 11 of support panel 10 parallel with and adjacent a surface of transparent wall 40. While the use of suction cups is illustrated in FIG. 2, it will be readily appreciated that various other means such as adhesives, clamps, magnets, bolts and the like may be used to attach the display shelf to a transparent wall.

In the embodiment illustrated in FIG. 1, slots 50 are formed adjacent the outer edges of flanges 33 and have entrances at the extreme outer edges 13, 14. If desired (and to permit more secure mounting of the shelf) slots 51 (see FIG. 5) may be formed in the lower edge of support panel 10 and arranged so that the entrance of each slot 51 is at the lower edge of support panel 10. Alternatively (or in conjunction with other slots, holes or the like), slots 52 (see FIGS. 5, 6 and 8) may be formed in flanges 33, 34 and arranged to have their entrances at the edge of the flange which joins the containment wall. It will be appreciated that various other combinations and arrangements of slots, holes and the like may be used to mount the display shelf adjacent a transparent wall.

It will be apparent from the foregoing that the principles of the invention may be used to form display shelves which support substantially cylindrical containers such as bottles, cans and the like vertically as well as to form display shelves which support elongated packages or products such as candy bars and the like horizontally. In each case the product or package is supported on the floor of the shelf and visible through the transparent wall on which the shelf is mounted.

It is to be understood that even though numerous characteristics and advantages of the invention have been set forth in the foregoing description together with details of the structure and function of the invention, this disclosure is to be considered illustrative only. Various changes and modifications may be made in detail, especially in matters of shape, size, arrangement and combination of parts, without departing from the spirit and scope of the invention as defined by the appended claims.

What is claimed is:

1. A shelf for supporting and displaying elongated products adjacent one face of a substantially transparent panel comprising:

(a) a support panel having a first face lying in a substantially vertical plane and defining a lower edge, first and second laterally opposed end edges, and an upper edge;

(b) a floor having a top face lying in a substantially horizontal plane substantially normal to and intersecting said vertical plane above the lower edge of the support panel and defining the upper edge of the support panel for a substantial portion of the lateral distance between the laterally opposed ends of the support panel; and (c) a containment wall extending upwardly from the top face of said floor with a substantial portion thereof spaced horizontally from and substantially parallel with the plane of said first face of said support panel and including a plurality of sections with each section shaped to define a containment compartment for an individual product.

2. A shelf as defined in claim 1 wherein said containment wall comprises a plurality of joined semi-cylindrical sections.

3. A shelf as defined in claim 1 wherein said containment wall includes a plurality of arcuate-shaped dividers.

4. A shelf as defined in claim 1 wherein said containment wall includes a plurality of substantially parallel vertically aligned slots.

5. A shelf as defined in claim 4 wherein said floor includes slots joining and defining horizontal extensions of said vertically aligned slots.

6. A shelf as defined in claim 4 wherein said vertically aligned slots extend the full vertical height of said containment wall and divide said containment wall into a plurality of substantially vertically extending fingers.

7. A shelf as defined in claim 1 wherein each end of said containment wall joins said support panel at a position interiorly spaced from said first and second laterally opposed edges and said support panel extends upwardly from the plane of the floor and outwardly from the ends of said containment wall to define support flanges having first faces coplanar with said first face of said support panel.

8. A shelf as defined in claim 7 including at least one mounting slot in each said support flange.

9. A shelf as defined in claim 8 wherein said mounting slot defines an entrance at the lower edge of the support flange.

10. A shelf as defined in claim 8 wherein said mounting slot defines an entrance at the outer edge of the support flange.

11. A shelf as defined in claim 8 wherein said mounting slot defines an entrance at the edge of the support flange which joins the containment wall.

12. The combination comprising:

(a) a substantially transparent wall having first and second oppositely disposed and substantially vertically aligned faces; and (b) a shelf for supporting and displaying elongated products adjacent the first face of said substantially transparent wall comprising:

(i) a support panel having a first face lying in a substantially vertical plane and defining a lower edge, first and second laterally opposed end edges, and an upper edge;

(ii) a floor having a top face lying in a substantially horizontal plane substantially normal to and intersecting said vertical plane above the lower edge of the support panel and defining the upper edge of the support panel for a substantial portion of the lateral distance between the laterally opposed ends of the support panel;

(iii) a containment wall extending upwardly from the top face of said floor with a substantial portion thereof spaced horizontally from and substantially parallel with the plane of said first face of said support panel and including a plurality of sections with each section shaped to define a containment compartment for an individual product; and (iv) means attaching said support panel to and substantially parallel with the first face of said substantially transparent wall.

13. The combination defined in claim 12 wherein said substantially transparent wall forms at least part of one wall of a refrigerated vault.

14. The combination defined in claim 12 wherein said substantially transparent wall forms at least part of a door.

15. The combination defined in claim 12 further comprising a plurality of substantially cylindrical containers arranged substantially vertically on said floor and visible through said substantially transparent wall.

16. The combination defined in claim 12 further comprising a plurality of elongated products arranged substantially horizontally on said floor and visible through said substantially transparent wall.

17. The combination comprising:

(a) a substantially transparent wall having first and second oppositely disposed and substantially vertically aligned faces; and (b) a shelf for supporting and displaying elongated products adjacent the first face of said substantially transparent wall comprising:

(i) a support panel having a first face lying in a substantially vertical plane and defining a lower edge, first and second laterally opposed end edges, and an upper edge;

(ii) a floor having a top face lying in a substantially horizontal plane substantially normal to and intersecting said vertical plane above the lower edge of the support panel and defining the upper edge of the support panel for a substantial portion of the lateral distance between the laterally opposed ends of the support panel and a plurality of dividers formed in and/or projecting from the top surface thereof defining containment compartments for a plurality of individual products; and (iii) a containment wall extending upwardly from the top face of said floor with a substantial portion thereof spaced horizontally from and substantially parallel with the plane of said first face of said support panel; and (iv) means attaching said support panel to and substantially parallel with the first face of said substantially transparent wall.

18. The combination defined in claim 17 wherein said substantially transparent wall forms at least part of one wall of a refrigerated vault.

19. The combination defined in claim 17 wherein said substantially transparent wall forms at least part of a door.

20. The combination defined in claim 17 further comprising a plurality of substantially cylindrical containers arranged substantially vertically on said floor and visible through said substantially transparent wall.

21. The combination defined in claim 17 further comprising a plurality of elongated products arranged substantially horizontally on said floor and visible through said substantially transparent wall.

22. The combination comprising:

(a) a substantially transparent wall having first and second oppositely disposed and substantially vertically aligned faces; and (b) a shelf for supporting and displaying elongated products adjacent the first face of said substantially transparent wall comprising:

(i) a support panel having a first face lying in a substantially vertical plane and defining a lower edge, first and second laterally opposed end edges, and an upper edge;

(ii) a floor having a top face lying in a substantially horizontal plane substantially normal to and intersecting said vertical plane above the lower edge of the support panel and defining the upper edge of the support panel for a substantial portion of the lateral distance between the laterally opposed ends of the support panel;

(iii) a containment wall extending upwardly from the top face of said floor with a substantial portion thereof spaced horizontally from and substantially parallel with the plane of said first face of said support panel and with at least the upper portion of said containment wall curved outwardly in a direction away from the substantially vertical plane of said support panel; and (iv) means attaching said support panel to and substantially parallel with the first face of said substantially transparent wall.

23. The combination defined in claim 22 wherein said substantially transparent wall forms at least part of one wall of a refrigerated vault.

24. The combination defined in claim 22 wherein said substantially transparent wall forms at least part of a door.

25. The combination defined in claim 22 further comprising a plurality of substantially cylindrical containers arranged substantially vertically on said floor and visible through said substantially transparent wall.

26. The combination defined in claim 22 further comprising a plurality of elongated products arranged substantially horizontally on said floor and visible through said substantially transparent wall.

27. A shelf for supporting and displaying elongated products adjacent one face of a substantially transparent panel comprising:

(a) a support panel having a first face lying in a substantially vertical plane and defining a lower edge, first and second laterally opposed end edges, and an upper edge;

(b) a floor having (i) a top face lying in a substantially horizontal plane substantially normal to and intersecting said vertical plane above the lower edge of the support panel and defining the upper edge of the support panel for a substantial portion of the lateral distance between the laterally opposed ends of the support panel and (ii) a plurality of dividers formed in and/or projecting from the top surface thereof defining containment compartments for a plurality of individual products; and (c) a containment wall extending upwardly from the top face of said floor with a substantial portion thereof spaced horizontally from and substantially parallel with the plane of said first face of said support panel.

28. A shelf for supporting and displaying elongated products adjacent one face of a substantially transparent panel comprising:

(a) a support panel having a first face lying in a substantially vertical plane and defining a lower edge, first and second laterally opposed end edges, and an upper edge;

(b) a floor having a top face lying in a substantially horizontal plane substantially normal to and intersecting said vertical plane above the lower edge of the support panel and defining the upper edge of the support panel for a substantial portion of the lateral distance between the laterally opposed ends of the support panel; and (c) a containment wall extending upwardly from the top face of said floor with a substantial portion thereof spaced horizontally from and substantially parallel with the plane of said first face of said support panel and with at least the upper portion of said containment wall curved outwardly in a direction away from the substantially vertical plane of said support panel.

* * * * *

US005913433C1

(12) EX PARTE REEXAMINATION CERTIFICATE (8009th)

United States Patent
Belokin et al.

(10) Number: US 5,913,433 C1
(45) Certificate Issued: Feb. 1, 2011

(54) DISPLAY SHELF FOR ELONGATED PRODUCTS

(75) Inventors: Paul Belokin, Denton, TX (US); Martin P. Belokin, Denton, TX (US); Norman P. Belokin, Corinth, TX (US)

(73) Assignee: Displays by Martin Paul Creative Center, Inc., Denton, TX (US)

Reexamination Request:
No. 90/007,729, Sep. 26, 2005

Reexamination Certificate for:

| | |
|---|---|
| Patent No.: | **5,913,433** |
| Issued: | **Jun. 22, 1999** |
| Appl. No.: | **08/998,193** |
| Filed: | **Dec. 24, 1997** |

(51) Int. Cl.
*A47F 5/08* (2006.01)
*A47F 5/00* (2006.01)

(52) U.S. Cl. ..... 211/90.01; 211/85.18; 211/75; 211/88.01; 248/206.4

(58) Field of Classification Search ..... None
See application file for complete search history.

(56) References Cited

U.S. PATENT DOCUMENTS

| | | | | | |
|---|---|---|---|---|---|
| 2,593,697 | A | * | 4/1952 | Reilly | 108/149 |
| 4,508,303 | A | * | 4/1985 | Beckerer, Jr. | 248/311.2 |
| 4,984,693 | A | * | 1/1991 | Belokin et al. | 211/88.01 |
| D323,766 | S | * | 2/1992 | Robbins et al. | D7/590 |
| 5,096,272 | A | * | 3/1992 | Belokin et al. | 312/129 |

* cited by examiner

*Primary Examiner*—Beverly M. Flanagan

(57) ABSTRACT

A display shelf which employs a mounting or support panel for attachment to one face of a transparent wall is provided with a floor which projects from the top edge of the support panel and a containment wall which projects upwardly from the floor. The support panel does not extend above the floor in the area which supports displayed product so that the product is visible through the transparent wall. Advertising material may be displayed on the support panel below the floor and the containment wall and/or floor may be appropriately shaped to provide individual compartments for each unit of product displayed.

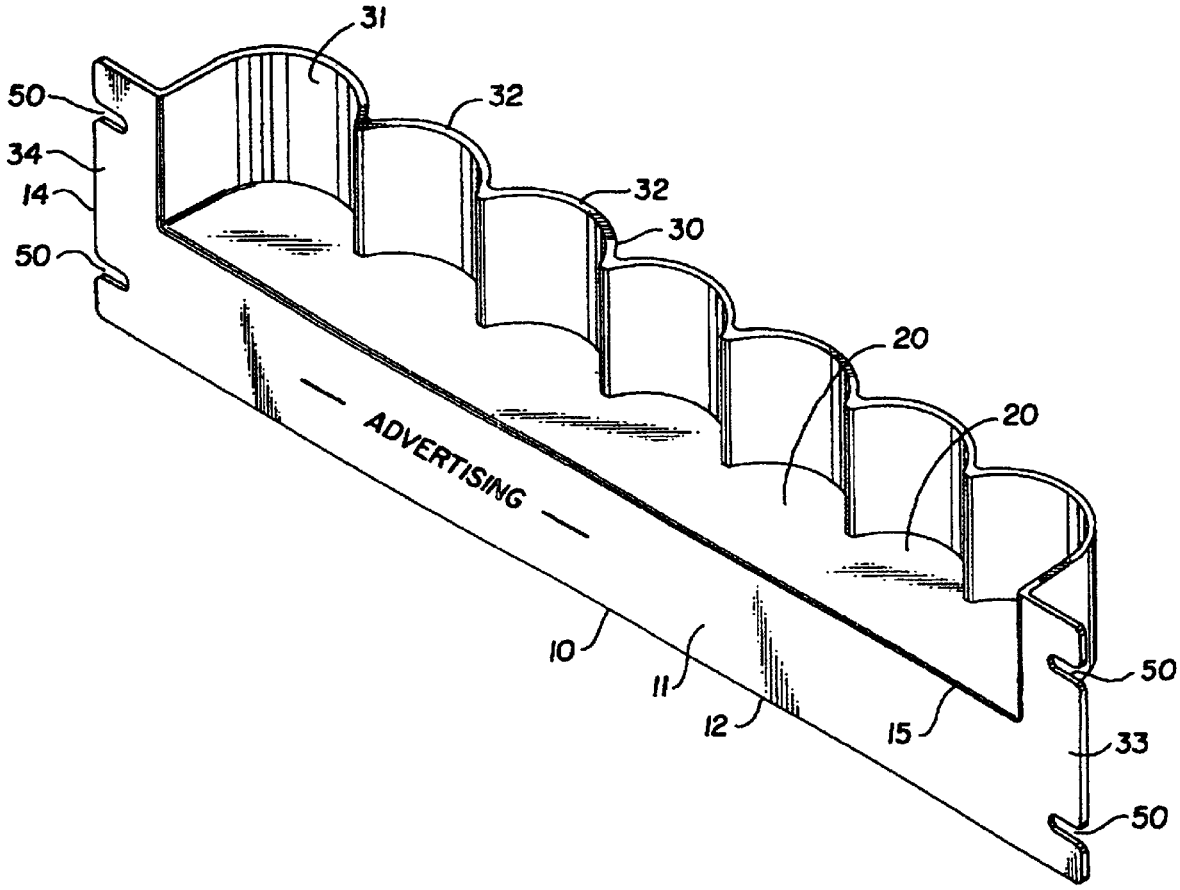

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 2, 8-11 and 17-28 is confirmed.

Claims 1, 3-7 and 12-16 are cancelled.

* * * * *